US006270339B1

(12) United States Patent
Zou

(10) Patent No.: US 6,270,339 B1
(45) Date of Patent: Aug. 7, 2001

(54) PRAYER CANDLE DEVICE

(76) Inventor: Cindy Zou, 2331 Finlandia La., #81, Clearwater, FL (US) 33763

( * ) Notice: Subject to any disclaimer, the term of this patent is extended or adjusted under 35 U.S.C. 154(b) by 0 days.

(21) Appl. No.: 09/717,689

(22) Filed: Nov. 22, 2000

Related U.S. Application Data

(63) Continuation-in-part of application No. 09/535,721, filed on Mar. 27, 2000.

(51) Int. Cl.[7] ..... F21L 27/00
(52) U.S. Cl. ..... 431/253; 431/316; 362/228
(58) Field of Search ..... 431/125, 126, 431/288, 289, 290, 315, 316, 317, 253; 362/161, 228, 234, 253; D26/22

(56) References Cited

U.S. PATENT DOCUMENTS 2,831,331 * 4/1958 Rodman ..... 431/125
3,236,072 * 2/1966 Goldszmid ..... 431/125
3,762,857 * 10/1973 Andeweg ..... 431/289

* cited by examiner

*Primary Examiner*—Sara Clarke
(74) *Attorney, Agent, or Firm*—John Lezdey & Assoc

(57) ABSTRACT

A prayer candle device includes a tubular body having a chamber provided therein, a consumable lighting element refillably disposed in the chamber including a wick mounted in the consumable lighting element, a holding means mounted in the chamber of the tubular body for holding the consumable lighting element in position, and an adjusting means for maintaining a burning end of the wick of the consumable lighting element at an upper position. In such arrangement, the prayer candle device is capable of avoiding the malfunction of the operation caused by the burned consumable material.

5 Claims, 5 Drawing Sheets

PRAYER CANDLE DEVICE

CROSS REFERENCE OF RELATED APPLICATION

This is a continuation-in-part of application Ser. No. 09/535,721, filed Mar. 27, 2000.

BACKGROUND OF THE PRESENT INVENTION

This is a divisional application of a regular application having an application of The present invention relates to candle, and more particularly to a prayer candle device which can provide an atmospheric or decorative touch.

Historically, people have used candle at home, church, or other places of worship to provide an atmospheric or decorative touch. In order to hold the candle in place, a candle container is used such that the candle is prevented from accidentally falling down and causing an unwanted fire. The conventional candle container comprises a hollow cylindrical body defining a candle cavity therein such that a candle is adapted for inserting into the candle cavity. A spring is inserted into the candle cavity such that the spring will normally urge the candle upwardly to maintain the burning end at upper position.

However, when lighting the burning end of the candle inside the candle container, the consumable material, such as wax, of the candle will start melting. The melted consumable material will flow back into the candle container such that when the consumable material is condensed inside the candle cavity, the rest of the unburned candle may stick inside the candle container which is hard to clean up. Some melted candle materials may flow out of the candle container and stick on the outer surface thereof. Worse, the melted candle material may not only destroy the beauty of the candle container but also damage the decoration on the surface of the candle container.

Some improved candle containers comprises a drain opening such that when the candle material flows into the interior of the candle container, a user is able to flush the accumulated candle material through the drain opening. However, when the candle material is condensed at the bottom of the candle cavity where the spring is positioned therein, the spring may lose its elastic properties while the candle material is stuck around the spring. The user may need to replace the spring as well or flush all the candle material several times within lighting one candle. So, the conventional candle container has some drawbacks on usage under a certain circumstances.

SUMMARY OF THE PRESENT INVENTION

A main object of the present invention is to provide a prayer candle device which can provide an atmospheric or decorative touch.

Another object of the present invention is to provide a prayer candle device which is adapted for operating by regular consumable candle or oil with wick.

Another object of the present invention is to provide a prayer candle device wherein the melted candle material may flow into a chamber in order to prevent the malfunction of the operation.

Accordingly, in order to accomplish the above objects, the present invention provides a prayer candle device, which comprises:

a tubular body comprising a chamber provided therein, an open end defining a supporting rim and a base;

a consumable lighting element refillably disposed in the chamber of the tubular body comprising a wick mounted in the consumable lighting element;

a holding means mounted in the chamber of the tubular body for holding the consumable lighting element in position;

a cover, which is fitly disposed on the supporting rim of the tubular body, having a through hole mounted thereon wherein the wick of the consumable lighting element is adapted to be penetrated through the through hole; and an adjusting means for urging a burning end of the wick of the consumable lighting element at an upper position.

DETAILED DESCRIPTION OF THE PREFERRED EMBODIMENT

Figure 1:
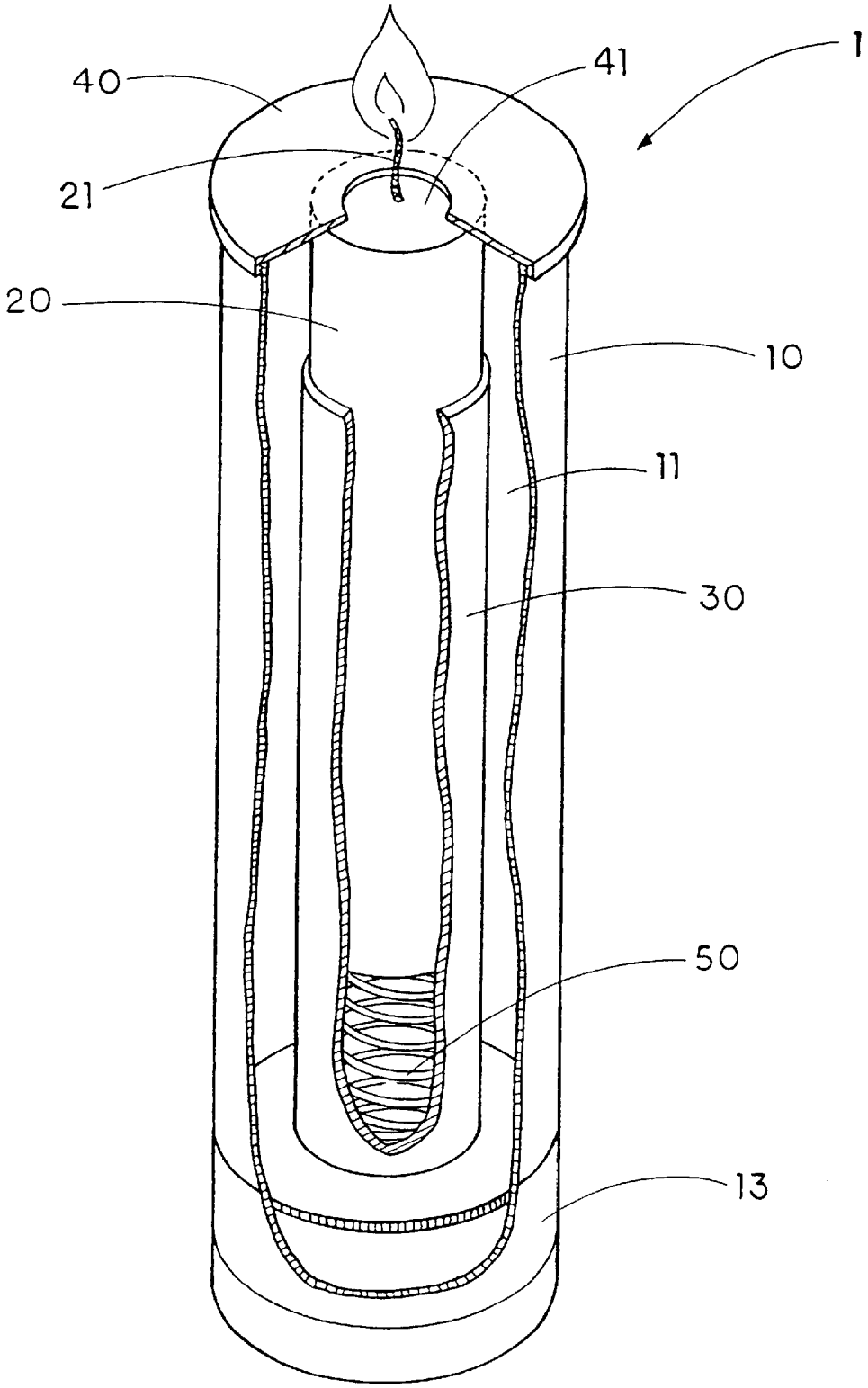
FIG. 1 is a perspective view of a prayer candle device according to a first preferred embodiment of the present invention.
Figure 2:
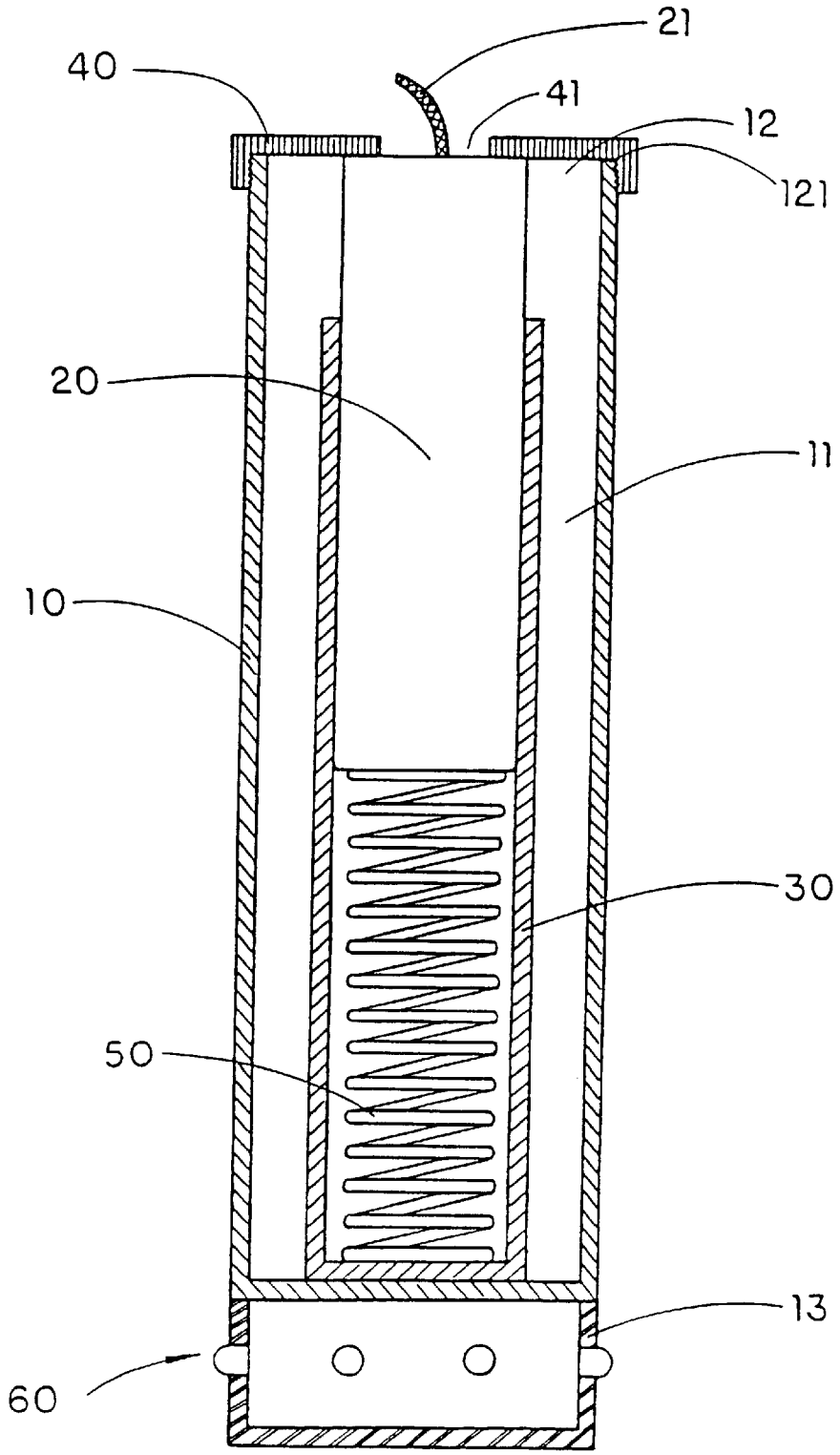
FIG. 2 is a sectional view of the prayer candle device according to the above first preferred embodiment of the present invention.

Referring to FIGS. 1 and 2 of the drawings, a prayer candle device 1 according to a first preferred embodiment of the present invention is illustrated, which comprises a tubular body 10, a consumable lighting element 20, a holding means 30, a cover 40, and an adjusting means 50.

The tubular body 10 comprises a cylindrical chamber 11 provided therein, an open end 12 defining a supporting rim 121 and a base 13 for stabilizing the prayer candle device 1. The consumable lighting element 20, which is refillably disposed in the chamber 11 of the tubular body 10, comprises a wick 21 mounted in the consumable lighting element 20. The holding means 30 for holding the consumable lighting element 20 in position is mounted in the chamber 11 of the tubular body 10. The cover 40, which is fitly disposed on the supporting rim 121 of the tubular body 10, comprises a through hole 41 mounted at a center thereon wherein the wick 21 of the consumable lighting element 20 is adapted to be penetrated through the through hole 41. The adjustable means 50 for urging a burning end of the wick 21 of the consumable lighting element 20 at an upper position.

Preferably, the tubular body 10 is made of material having transparent properties such as crystal or glass so that the light can be reflected through the tubular body 10 for providing an esthetically pleasing appearance. Furthermore, a three-dimensional figure of decorations such as angels, flowers, "JESUS CHRIS", the "POPE" or "JOHN PAUL" can be mounted inside and/or an outer surface of the tubular body 10 for further providing an atmospheric or decorative touch.

According to the first preferred embodiment of the present invention, the consumable lighting element 20 is a candle which is constructed by a consumable material such as wax. The wick 21 is mounted inside the consumable light element 20 wherein when the burning end of the wick 21 is lit up, the consumable light element 20 will start to melt.

The holding, means 30 is a tubular container, preferably made of same material of the tubular body 10 such as crystal or glass, wherein the holding means 30 has a diameter slightly larger than the diameter of the consumable lighting element 20 and smaller than a diameter of the tubular body 10. Furthermore, the holding means 30 is detachably mounted at its bottom in the chamber 11 of the tubular body 10, preferably the holding means 30 is screwed on the tubular body 10, such that a user can detach the holding means 30 for easy clean up and fitly placing the consumable lighting element 20 therein.

The adjusting means 50 according to the first preferred embodiment is a compressive spring wherein the adjusting means 50 is fitly disposed in the holding means 30. The adjusting means 50 has two ends biasing the bottom of the holding means 30 and the bottom end of the consumable lighting element 20 respectively such that the adjusting means 50 normally urges the consumable lighting element 20 in an upper position.

The cover 40 having a respective circular shaped is detachably disposed on the supporting rim 121 of the tubular body 10, wherein the cover 40 is adapted to tightly close the open end 12 of the tubular body 10. When the cover 10 is placed on the supporting rim 121 for closing the open end 12 of the tubular body 10, the consumable lighting clement 20 at its top end biases a ceiling of the cover 40 while at its bottom end is biased by the adjusting means 50. So, the burning end of the wick 21 of the consumable lighting element 20 is extended through the through hole 41 of the cover 40 to outside.

Accordingly, when the burning end of the wick 21 is lit up. The consumable lighting element 20 will start melting. The melting consumable lighting element 20 will flow and collect in the chamber 11 between the interior of the tubular body 10 and the exterior of the holding means 30 instead of flowing into the holding means 30 so as to prevent the adjusting means 50 from being stuck as well as losing its elasticity. So, the prayer candle device 1 can prevent the malfunction of the operation.

In order to operate the prayer candle device 1, a user must open up the cover 40 and insert the consumable lighting element 20 into the holding means 30. Then close the cover 40 tightly in order to compress the spring of the adjusting means 50 by the cover 40 through the consumable lighting element 20 while the burning end of the wick 21 is penetrated through the through hole 41 of the cover 40 to communicate with outside. For flushing the accumulated candle material in the chamber 11, a candle material solvent or heated liquid such as hot water can be used to dissolve the candle material and drain off from the tubular body 10.

Figure 3:
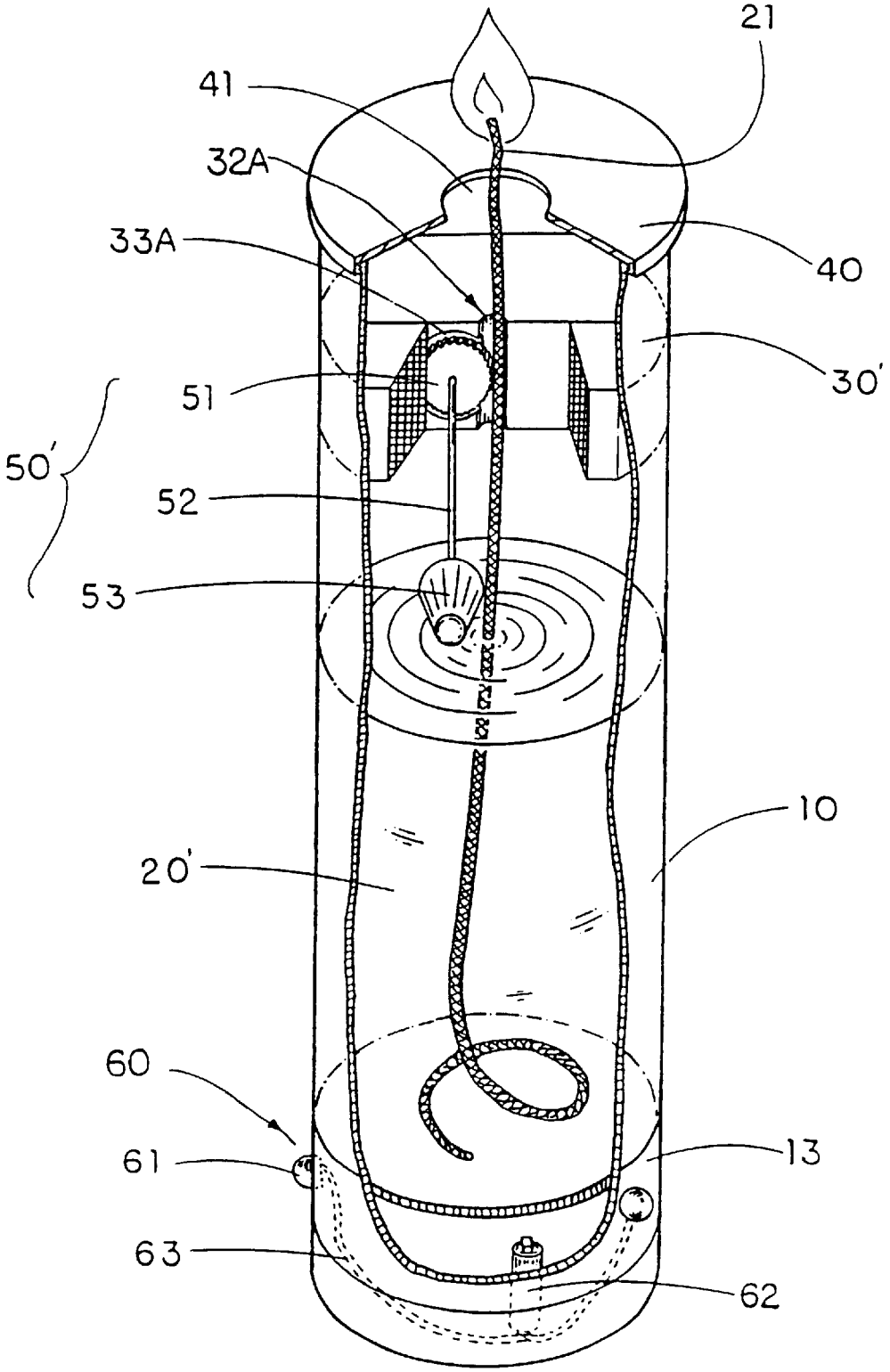
FIG. 3 is a perspective view of the prayer candle device according to a second preferred embodiment of the present invention.
Figure 4:
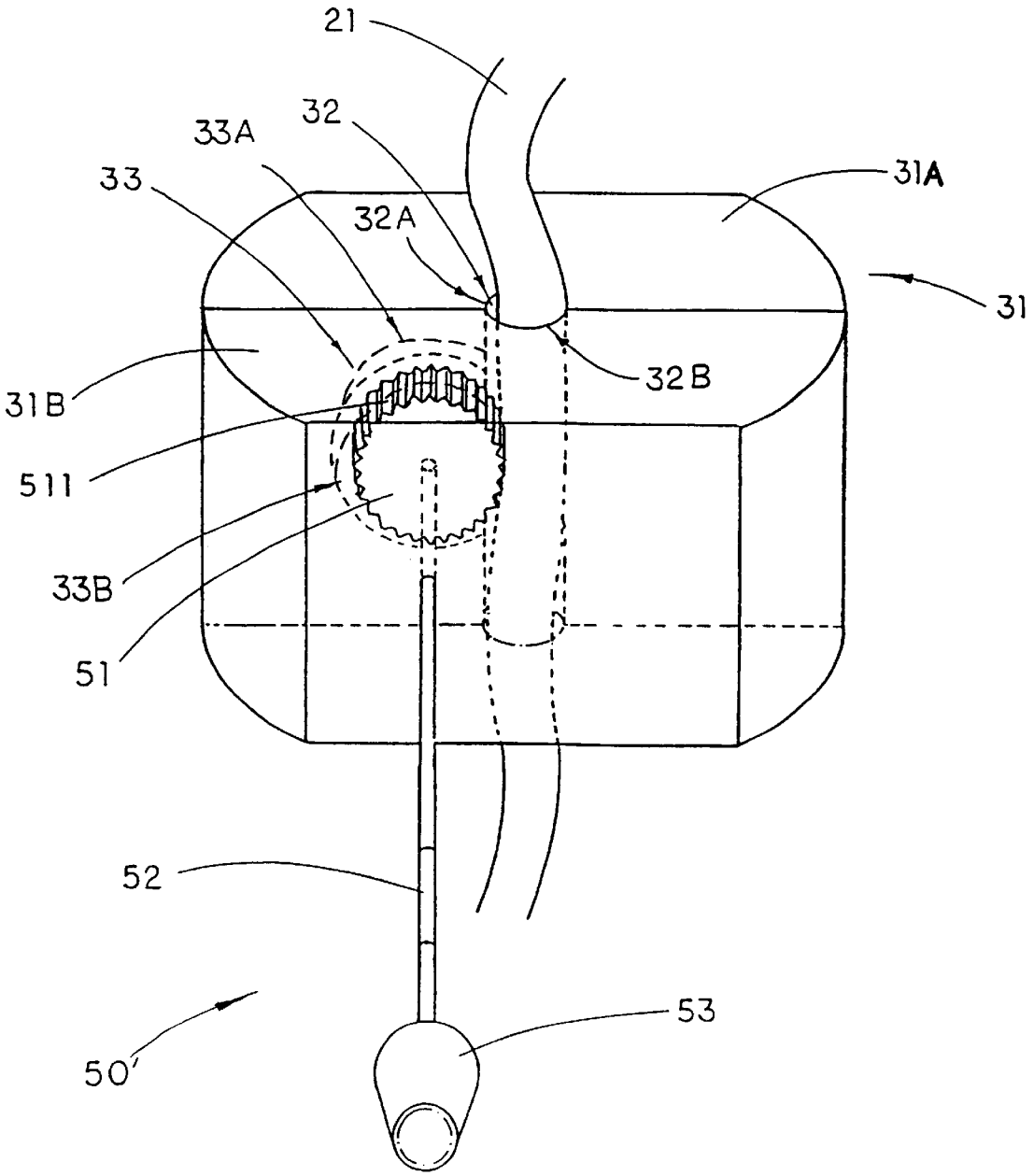
FIG. 4 is a partial sectional view of the prayer candle device according to the above second preferred embodiment of the present invention, illustrating the adjustable means.

Referring to FIGS. 3 and 4 of the drawings, the prayer candle device 1 according to a second preferred embodiment of the present invention is illustrated, wherein the consumable lighting element 20' is a burning oil and is absorbed by the wick 21 disposed therein. So, when the burning end of the wick 21 is lit up, the wick will keep absorbing the consumable lighting element 20' as a fuel while the wick 21 is being burnt up and shortening its length.

The holding means 30' comprises an elongated body 31 extended from an interior surface of the tubular body 10 wherein the elongated body 31 comprises two identical members 31*a*, 31*b* mounted together. Each member 31*a* (31*b*) has an elongated slot and a circular wheel cavity 33*a* (33*b*) respectively mounted on a surface thereof such that a wick through hole 32 and a wheel cavity 33 are formed on the elongated body 31 by mounting the two respective surface of two members 31*a*, 31*b* together. The wick 21 is adapted for fitly penetrating the elongated body 31 through the wick through hole 32. In other words, the elongated body 31 has two side ends each extended from the interior surface of the tubular body 10 such that the elongated body 31 is firmly affixed in the chamber without any vertical or rotatable movement.

Referring to FIG. 4, the adjustable means 50' comprises a circular engaging wheel 51 rotatably disposed in the wheel cavity 33 of the elongated body 31 of the holding means 30 wherein a plurality of engaging teeth 511 are evenly mounted on a circumference of the engaging wheel 51 for providing friction to the wick 21, an elongated axle 52 coaxially and outwardly extended from the engaging wheel 51 and rotatably penetrated through the elongated body 31 and the tubular body 10 respectively for communicating with outside, and a driving wheel 53 coaxially mounted on a free end of the elongated axle 52.

The engaging wheel 51 is driven to be rotated by the driving wheel 53 through the elongated axle 52 such that when the driving wheel 53 is being rotated, the engaging wheel 51 is driven to be rotated with the same direction of the driving wheel 53. Furthermore, the engaging teeth 511 of the engaging wheel 51 are fitly engaged with the wick 21 placed in the wick through hole 32 such that when the engaging wheel 51 is being rotated, the wick 21 is arranged to be driven in a vertical movable manner. In such arrangement, the user is able to adjust the displacement of the burning end of the wick 21. In other words, when the burning end of the wick 21 is being burnt up, the user can rotate the driving wheel 53 in order to lift up the wick 21.

To operate the prayer candle device 1 according to the second preferred embodiment of the present invention, the user can open the cover 40 so as to pour the burning oil of the consumable lighting element 20' into the chamber 11 of the tubular body 10. Carefully placing the wick 21 having a predetermined length into the wick through hole 32 of the elongated body 31 while the engaging teeth 511 of the engaging wheel 51 are fitly engaged with the wick body. Then the burning end of the wick 21 is penetrated through the through hole 41 of the cover 40 wherein the length of the burning end of the wick 21 is adjusted by the driving wheel 53 of the adjusting means 50'.

Figure 5:
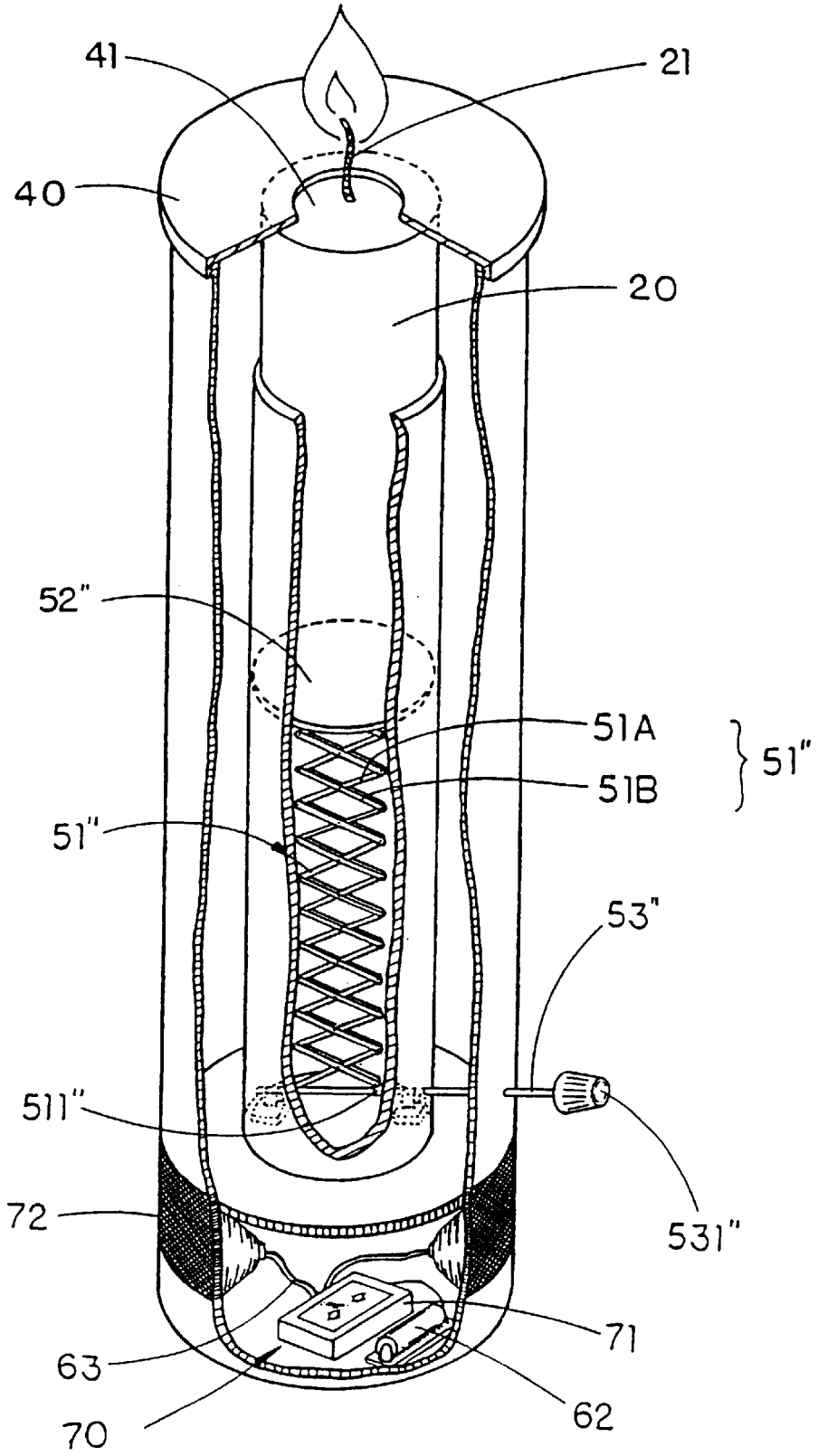
FIG. 5 is a sectional view of the prayer candle device according to a third preferred embodiment of the present invention.

Referring to FIG. 5 of the drawing, the prayer candle device 1 according to the third embodiment is illustrated, which has similar configuration as the above first embodiment. The third embodiment basically is an alternative mode of the first embodiment to illustrate a possible modification thereof.

The adjusting means 50" comprises a plurality pair of supporting arms 51" pivotally connected each other, a platform 52" for supporting the consumable lighting element 20 thereon, and an adjusting axle 53" for lifting up and down the platform 52".

Each pair of supporting arms 51" comprises a first supporting arm 51*a* and a second supporting arm 51*b* pivotally connected each other at a middle thereof to form a "X" structure wherein each pair of supporting arms 51" is pivotally connected at a top end of supporting arm 51" to a bottom end of each supporting arm 51" of another pair of supporting arms 51" in such manner when each supporting arm 51" of a bottom pair of the supporting arms 51" is pivotally rotated in opposite direction in a scissors-like manner, narrowing the cross structure of each pair of supporting arms 51" to near vertical position, as the height of the plurality of supporting arms 51" is lengthened. Furthermore, two through holes 511" are coaxially mounted on a bottom pair of the supporting arms 51" at the bottom ends thereof respectively, wherein the adjusting axle 53" is adapted to be fitly inserted into the two through hole 511".

The circular platform 52" is affixed at its bottom surface to a top pair of the supporting arms 51" wherein the platform 52" has a diameter slightly smaller than a diameter of the holding means 30 such that platform 52" is fitly disposed therein a vertical movable manner.

An adjusting axle 53" having a threaded line mounted around thereon is rotatably inserted into the two through holes 511" of the bottom pair of supporting arms 51" in such manner the adjusting axle 53" is being rotated to narrow the cross structure the bottom pair of supporting arms 51" so as to lengthen the height thereof. The adjusting axle 53" further comprises an enlarged axle head 531" extended from one end of the adjusting axle 53" which is integrally extended and penetrated through the tubular body 10 to outside such that the axle head 531" is arranged to drive the adjusting axle to rotate. So, the user is able to adjust the height of the consumable lighting element 20 by rotating the axle head 531" to narrow and lengthen the pairs of supporting arms 51" so as to light up the platform 52". Furthermore, a motor (not shown in the figure) is adapted to be installed at the base 13 of the tubular body 10 such that the motor is arranged to mechanically control the adjusting axle 53" to rotate so as to adjust the height of the consumable lighting element 20.

Moreover, according to the first, second, and third embodiments of the present invention, the prayer candle device 1 further comprises a lighting means 60 mounted on the base 13 of the prayer candle device 1, as shown in FIG. 3. The lighting means 60 comprises a plurality of lighting elements 61 such as light bulb or LED encirclingly and evenly mounted on the base 13, a power supply 62 such as rechargeable battery for providing electrical power to the lighting element 61 mounted at the bottom of the base 13, and a plurality of connecting wires 63 each connected between the power supply 62 and the lighting elements 61. So, when the consumable lighting element 20 is not in used or being used up, the lighting means 60 can substitute the consumable light element 20 in order to light up the prayer candle device 1. Moreover, the lighting means 60 can further provide an esthetically pleasing appearance and decorative touch for the prayer candle device 1 of the present invention.

Alternatively, the prayer candle device 1, as shown in FIG. 5, comprises a sound generating means 70 comprising a tape recorder 71 installed at the bottom of the base 13 and a speaker 72 for outputting sound signal affixed on an outer surface of the base 13 wherein the power supply 62 is mounted at the bottom of the base 13 near to the tape recorder 71 and the connecting wires 63 for electrically connecting between the tape recorder 71, the speaker 72 and the power supply 62 by means of a closed circuit such that the sound generating means 70 is adapted for generating sound such as songs and praying messages from a prerecorded tape.

What is claimed is:

1. A prayer candle device, comprising:

a tubular body having a chamber therein, an open end defining a supporting rim and a base;

a consumable volatile liquid lighting element refillably disposed in said chamber of said tubular body, comprising a wick mounted therein;

a cover, which is fittedly disposed on said supporting rim of said tubular body, having a through hole provided thereon, wherein said wick of said consumable lighting element penetrates through said hole to outside;

an adjusting means for urging a burning end of said wick of said consumable volatile liquid lighting element at an upper position, through said cover; and, a lighting means mounted on said base of said tubular body wherein said lighting means comprises a plurality of lighting elements encirclingly and evenly mounted on said base, a power supply for providing electrical power to said lighting elements, and a plurality of connecting wires connected between said battery and said lighting elements respectively.

2. The prayer candle device as recited in claim 1 wherein said volatile liquid lighting means comprise an oil.

3. The prayer candle device as recited in claim 1, wherein said adjustable means comprises a circular engaging wheel rotatably disposed in a wheel cavity of said tubular body and communicating with said wick, an elongated axle coaxially and outwardly extended from said engaging wheel and rotatably penetrated through said tubular body for communicating with the outside, and a driving wheel coaxially mounted on a free end of said elongated axle.

4. A prayer candle device, comprising:

a tubular body having a chamber therein, an open end defining a supporting rim and a base;

a consumable volatile liquid lighting element, which is refillably disposed in said chamber of said tubular body, comprising a wick mounted therein;

a holding means disposed in said chamber of said tubular body for holding said consumable lighting element in position, wherein said holding means has a diameter larger than a diameter of said consumable volatile liquid lighting element and smaller than a diameter of said tubular body;

a cover, which is fittedly disposed on said supporting rim of said tubular body, having a through hole provided thereon, wherein said wick of said consumable volatile liquid lighting element penetrates through said through hole to outside;

an adjusting means for urging a burning end of said wick of said consumable lighting element at an upper position, through said cover;

a lighting means and a sound generating means mounted on said base of said tubular body, and a power supply for providing electrical power to said lighting elements and said sound generating means.

5. The prayer candle device, as recited in claim 4, wherein said sound generating means comprises a tape recorder installed at a bottom of said base, a speaker for outputting sound affixed on an outer surface of said base, said power supply mounted at said bottom of said base, and a plurality of connecting wires for electrically connecting between said tape recorder, said speaker and said power supply in a closed circuit.

* * * * *